US008246044B2

(12) United States Patent
Nishitani et al.

(10) Patent No.: US 8,246,044 B2
(45) Date of Patent: Aug. 21, 2012

(54) SHEET FEEDING DEVICE AND IMAGE FORMING APPARATUS WITH LIFTING PLATE

(75) Inventors: Shuji Nishitani, Numazu (JP); Shinichi Ueda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/947,480

(22) Filed: Nov. 16, 2010

(65) Prior Publication Data

US 2011/0140347 A1 Jun. 16, 2011

(30) Foreign Application Priority Data

Dec. 16, 2009 (JP) ..... 2009-285755

(51) Int. Cl.
*B65H 1/08* (2006.01)

(52) U.S. Cl. ..... 271/127; 271/126

(58) Field of Classification Search ..... 271/126, 271/127, 147, 157, 160
See application file for complete search history.

(56) References Cited

U.S. PATENT DOCUMENTS

| | | | | |
|---|---|---|---|---|
| 4,874,159 | A * | 10/1989 | Maeno et al. | 271/171 |
| 7,708,265 | B2 * | 5/2010 | Kusama | 271/117 |
| 2003/0057635 | A1 * | 3/2003 | Fukushima et al. | 271/126 |
| 2006/0180987 | A1 * | 8/2006 | Hattori | 271/117 |
| 2008/0150219 | A1 * | 6/2008 | Nishizawa et al. | 271/127 |

FOREIGN PATENT DOCUMENTS

| | | | |
|---|---|---|---|
| JP | 59177233 | A * | 10/1984 |
| JP | 2000-219332 | A | 8/2000 |
| JP | 2007-031064 | A | 2/2007 |

* cited by examiner

*Primary Examiner* — Jeremy R Severson
(74) *Attorney, Agent, or Firm* — Canon USA Inc IP Division

(57) ABSTRACT

A sheet feeding device that feeds sheets by a sheet feeding unit from a sheet feeding cassette storing the sheets, in which positions of rotation centers of a lifting plate and a lifting plate pressing member are varied from each other in such a manner that a rotation track of an edge of an opening of the lifting plate pressing member and a rotation track of a vertical surface of an engaging member provided on the lifting plate intersect with each other, so that the edge is engaged with the vertical surface at the intersection position of the rotation tracks to restrict rotation of the lifting plate when the lifting plate moves upward before a lifting operation of the lifting plate pressing member.

6 Claims, 8 Drawing Sheets

SHEET FEEDING DEVICE AND IMAGE FORMING APPARATUS WITH LIFTING PLATE

BACKGROUND OF THE INVENTION

1. Field of the Invention

The present invention relates to a sheet feeding device mounted on an image forming apparatus such as a laser beam printer and a copying machine.

2. Description of the Related Art

An image forming apparatus is provided with a sheet feeding device for storing and feeding sheets. The sheet feeding device includes a sheet feeding cassette serving as a sheet storing device, a sheet feeding roller for feeding the sheets stored in the sheet feeding cassette, and a separation unit for separating the sheets to be fed by the sheet feeding roller one by one. An image is formed on the sheet fed by the sheet feeding device in an image forming unit provided in the image forming apparatus. The sheet feeding cassette includes a lifting plate that is attached rotatably to a cassette case, and the lifting plate is lifted up by a pressing member, so that the sheets supported by the lifting plate are pressed against the sheet feeding roller. The sheet feeding roller rotates to sequentially feed the sheets one by one from the sheet on the top.

Since the lifting plate is not fixed though it is attached to the cassette case, the lifting plate is caused to tumble due to vibration during transport such as shipping from a factory to break other parts of the sheet feeding cassette or is deformed in some cases. Therefore, it is necessary to fix the lifting plate and prevent the lifting plate from tumbling during transport. As a means for fixing the lifting plate, in general, the lifting plate has heretofore been fixed by using a packaging material such as foamed polystyrene and a cardboard.

Japanese Patent Application Laid-Open No. 2000-219332 discusses a configuration of fixing a lifting plate to a cassette case by using a dedicated fixing means such as a screw. In this configuration, before an image forming apparatus is put into use, the lifting plate is made rotatable by removing the fixing means.

Further, Japanese Patent Application Laid-Open No. 2007-031064 discusses an image forming apparatus in which a rear end restricting member for restricting a rear end position of a sheet is caused to slide, so that the rear end restricting member and a cassette case sandwich a lifting plate therebetween to fix the lifting plate. In this configuration, the image forming apparatus is used after making the lifting plate movable by slide-moving the rear end restricting member.

However, the packaging material or the fixing member is used only for the transport if the lifting plate is fixed using the fixing member such as the packaging material or the dedicated fixing member. The packaging material or the fixing member is not necessary and is not used after unpacking the apparatus. In short, the packaging material or the fixing member entails an increase in cost.

Further, if the lifting plate is fixed using the rear end restricting member for sheet position restriction, an extra labor of the user is required to move the rear end restricting member after unpacking the apparatus. Also, an elevation mechanism for lifting up the lifting plate may be broken when the image forming apparatus is actuated without moving the rear end restricting member.

SUMMARY OF THE INVENTION

The present invention is to provide a sheet feeding device that can prevent breakage, deformation, and the like during transport without an increase in cost, which is otherwise caused by a dedicated packaging material or a fixing member and without requiring a labor of a user.

According to an aspect of the present invention, there is provided a sheet feeding device that feeds sheets by a sheet feeding unit from a sheet feeding cassette storing the sheets, including a cassette case, a lifting plate that is rotatably supported in the cassette case, on which the sheets are placed, and a pressing member that is rotatably supported below the lifting plate and presses the sheet to the sheet feeding unit by lifting up the lifting plate, wherein positions of rotation centers of the lifting plate and the pressing member are varied from each other in such a manner that a rotation track of an engaging member provided on the lifting plate and a rotation track of an engaged member provided on the pressing member engaged with the engaging member, intersect with each other, so that the engaged member restricts the engaging member at the intersection position of the rotation tracks to restrict rotation of the lifting plate when the lifting plate moves upward ahead of a lifting operation of the pressing member.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Hereinafter, a first exemplary embodiment of a sheet feeding device and an image forming apparatus according to the present invention will be described with reference to FIGS. 1A to 7. Dimensions, materials, and relative positions of component parts described in the first exemplary embodiment do not limit the scope of the present invention unless described particularly specifically.

Figure 7:
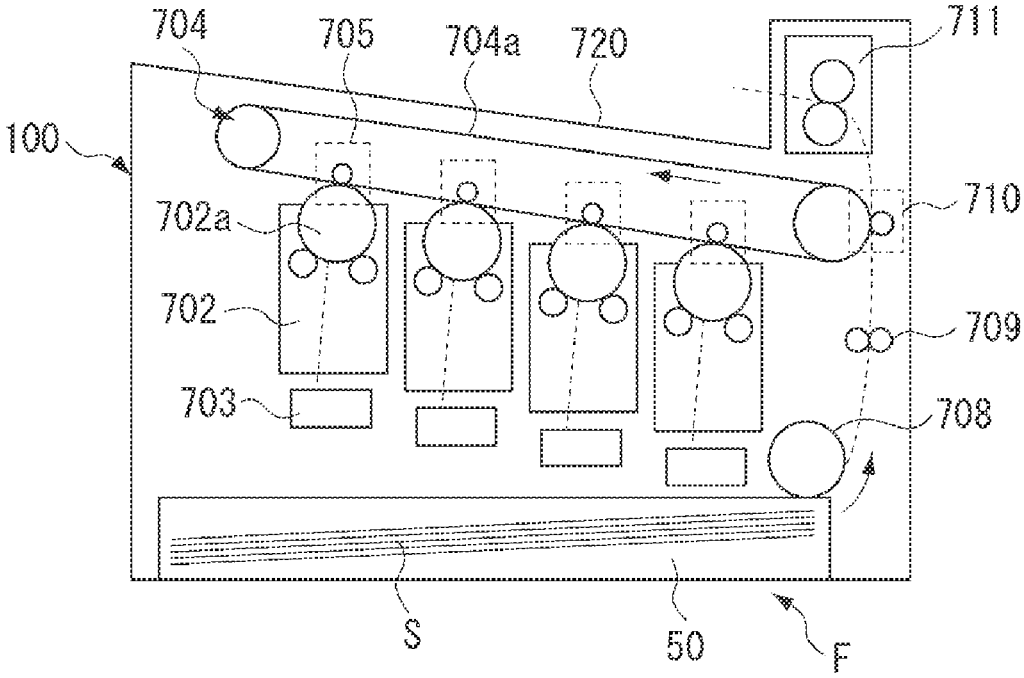
FIG. 7 is a sectional view illustrating an image forming apparatus provided with the sheet feeding cassette illustrated in FIGS. 1A and 1B.

Hereinafter, an entire configuration of the image forming apparatus provided with the sheet feeding device to which the present invention is adapted will briefly be described. FIG. 7 is a sectional view illustrating an entire configuration of a color laser printer (hereinafter referred to as printer) 100 which is one aspect of the image forming apparatus.

The printer 100 illustrated in FIG. 7 is provided with an image forming unit including four process cartridges 702 in each of which a photosensitive drum 702*a*, a charging unit, a developing unit, and a cleaner unit are integrated, a second transfer unit 710, and a fixing unit 711. The process cartridge 702 is detachably mounted on the printer 100. The four process cartridges 702 have an identical configuration and differ from one another by a color [yellow (Y), magenta (M), cyan (C), or black (Bk)] of toner for forming an image.

The charging unit is a conductive roller having the shape of a roller, and a surface of the photosensitive drum 702*a* is uniformly charged by bringing the conductive roller into contact with the surface of the photosensitive drum 702*a* and applying a bias voltage for charging by a power source not illustrated. Each of four exposure units 703 is provided below the process cartridge 702 to form an electrostatic latent image on the photosensitive drum 702*a* by performing light exposure on the photosensitive drum based on an image signal.

With the above-described configuration, the electrostatic latent images are formed by the exposure units 703 after each of the photosensitive drums 702*a* is charged by a predetermined negative potential by the charging roller. The developing units perform inversion development of the electrostatic latent images, and negative toner is attached, thereby forming a toner image in which the toner of Y, M, C, and Bk is overlapping with each other. An intermediate transfer belt unit 704 has a configuration that four first transfer rollers 705 opposed to the photosensitive drums 702*a* are disposed inside the intermediate transfer belt 704*a* and that a transfer bias is applied from a bias applying unit not illustrated. Thus, the toner images on the photosensitive drums 702*a* are firstly transferred onto the intermediate transfer belt 704*a* sequentially and fed to a second transfer unit 710 in the state where the four color toner images are overlapping with each other.

The sheet feeding device F is disposed at a lower part of the printer 100. The sheet feeding device F includes a sheet feeding cassette 50 serving as a sheet storing unit that stores sheets S, and a sheet feeding roller 708 that feeds the sheets S from the sheet feeding cassette 50, and a separation unit (not illustrated) that separates the thus-fed sheets S from one another. Also, a pair of registration rollers 709 that conveys the sheet separately fed by the sheet feeding device F is provided on a sheet conveying path between the sheet feeding device F and the image forming unit.

The sheets S stored in the sheet feeding cassette 50 is conveyed one by one in such a manner that the sheets S are brought into pressure contact with the sheet feeding roller 708 and separated by the separating unit. An inclination of the sheet S is corrected by the registration roller pair 709 and timing of sheet conveyance is coordinated with the image formation by the image forming unit. Then, the sheet is conveyed to the second transfer unit 710. In the second transfer unit 710, the toner image on the intermediate transfer belt 704*a* is secondarily transferred onto the fed sheet S. At the fixing unit 711 serving as an image fixing means fixes the toner image formed on the sheet by applying heat and a pressure onto the toner image. The sheet S is discharged to a sheet tray 720 after the image fixing.

Figure 5:
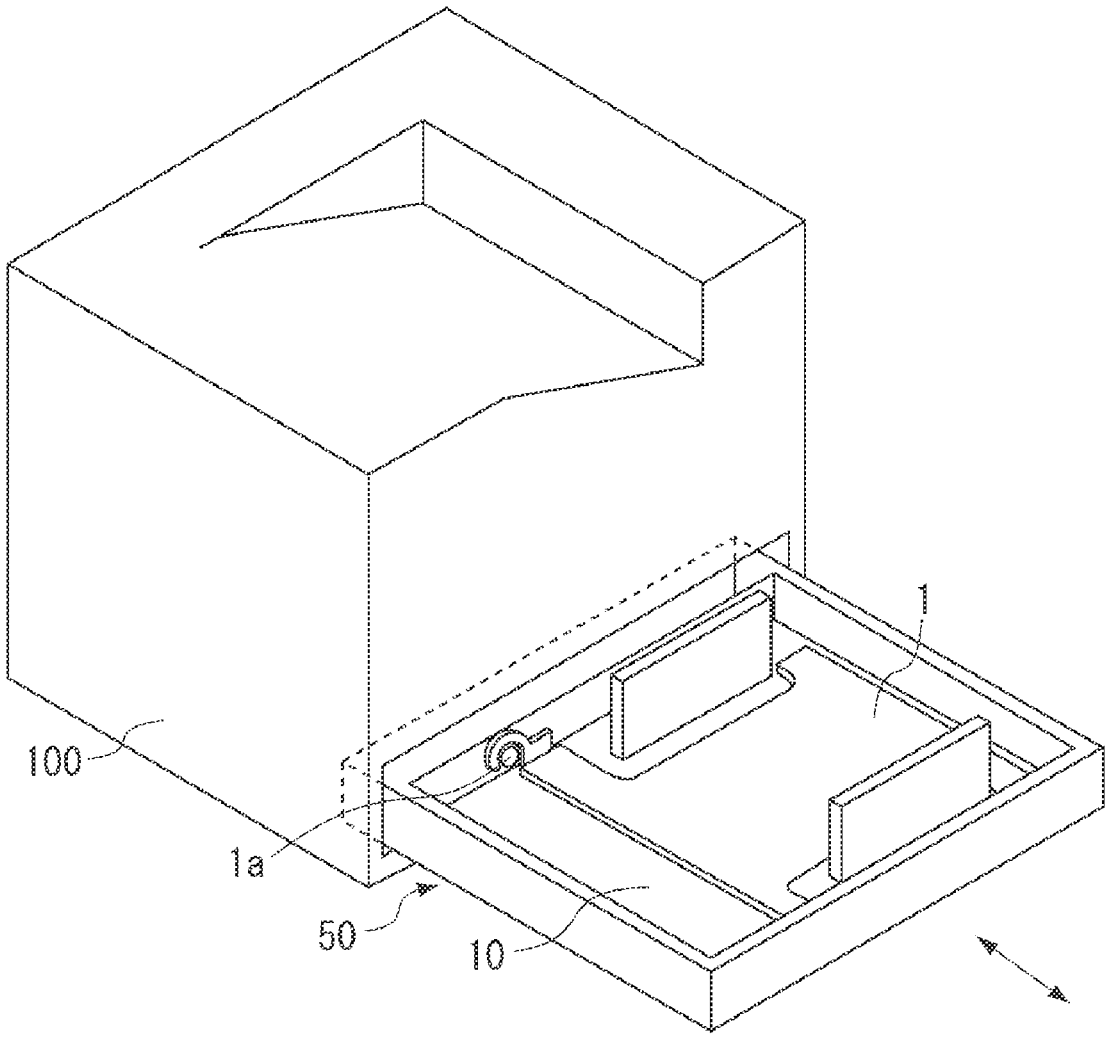
FIG. 5 is a perspective view illustrating states in which the sheet feeding cassette illustrated in FIGS. 1A and 1B is detachably mounted on an apparatus main body.

Hereinafter, the sheet feeding cassette 50 of the sheet feeding device F according to the first exemplary embodiment of the present invention will be described with reference to FIGS. 5 and 6. FIG. 5 is a diagram illustrating states in which the sheet feeding cassette is detachably mounted on an apparatus main body of the printer 100, wherein the sheet feeding cassette 50 is detachably mounted in directions of arrows toward the apparatus main body.

The apparatus main body includes the sheet feeding roller 708 (illustrated in FIG. 7). The sheet feeding cassette 50 is provided with a cassette case 10 that stores the sheets and a lifting plate 1 rotatably held by the cassette case 10, on which the sheets are placed. The lifting plate 1 is rotatably supported about a rotation center 1*a* and presses the supported sheets against the sheet feeding roller 708 when a lifting plate pressing member 2 lifts up the lifting plate 1.

Figure 6:
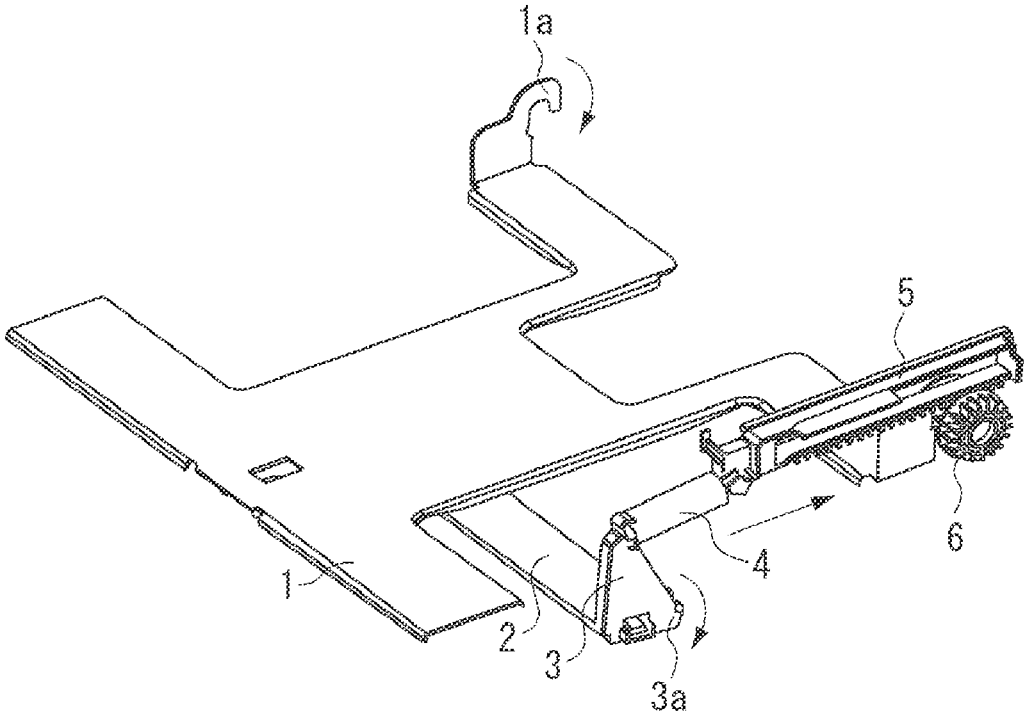
FIG. 6 is a perspective view illustrating a lifting plate pressing mechanism of the sheet feeding cassette illustrated in FIGS. 1A and 1B

FIG. 6 is a diagram illustrating a configuration of a pressing mechanism for lifting up the lifting plate 1 of the sheet feeding cassette 50.

The lifting plate pressing member 2 that is rotatable about a rotation center 2*a* is disposed below the lifting plate 1 and lifts up the lifting plate 1. A spring hooking unit 3 is attached to an edge of the lifting plate pressing member 2, and one end of a lifting plate biasing spring 4 which is a pull spring is attached to the spring hooking unit 3. The other end of the lifting plate biasing spring 4 is attached to a slide rack 5, and rack teeth formed on the slide rack 5 are engaged with a lifting plate pressing gear 6. The lifting plate pressing gear 6 is engaged with a driving gear (not illustrated) provided in the apparatus main body. The driving gear is rotated by a driving unit such as a motor to pull the lifting plate biasing spring 4 in a direction of an arrow, so that the lifting plate pressing member 2 is rotated to lift up the lifting plate 1. Thus, the sheets supported on the lifting plate 1 are pressed against the sheet feeding roller 708.

Figure 3A:
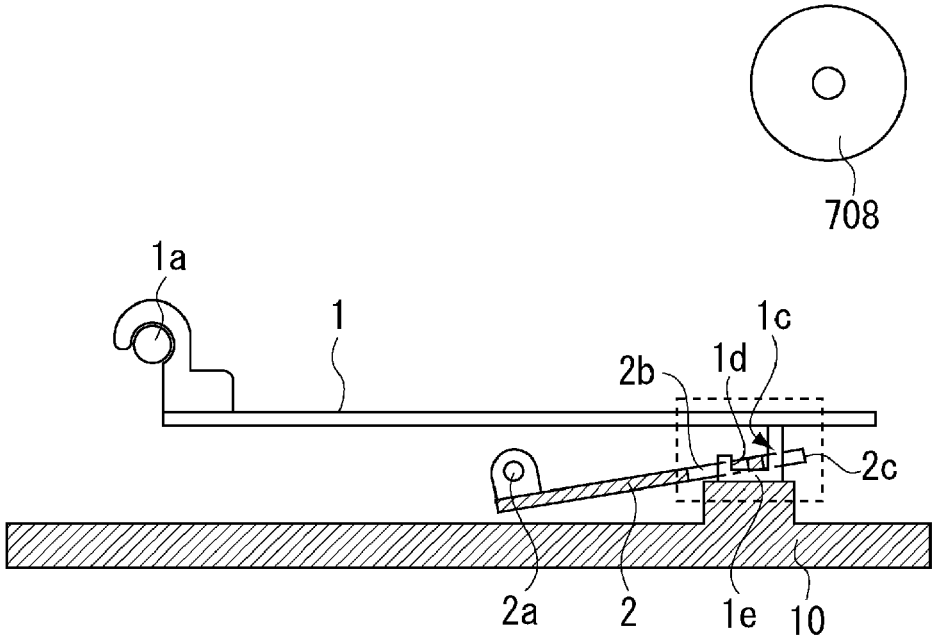
FIGS. 3A and 3B are sectional views each illustrating an operation of the lifting plate of the sheet feeding cassette illustrated in FIGS. 1A and 1B during image formation.
Figure 3B:
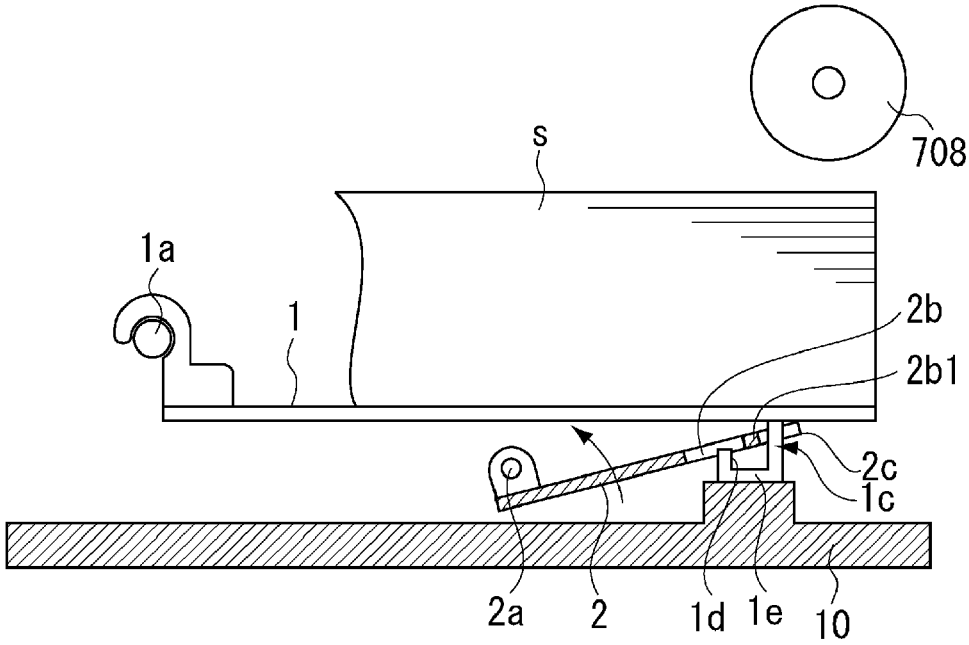
Figure 4A:
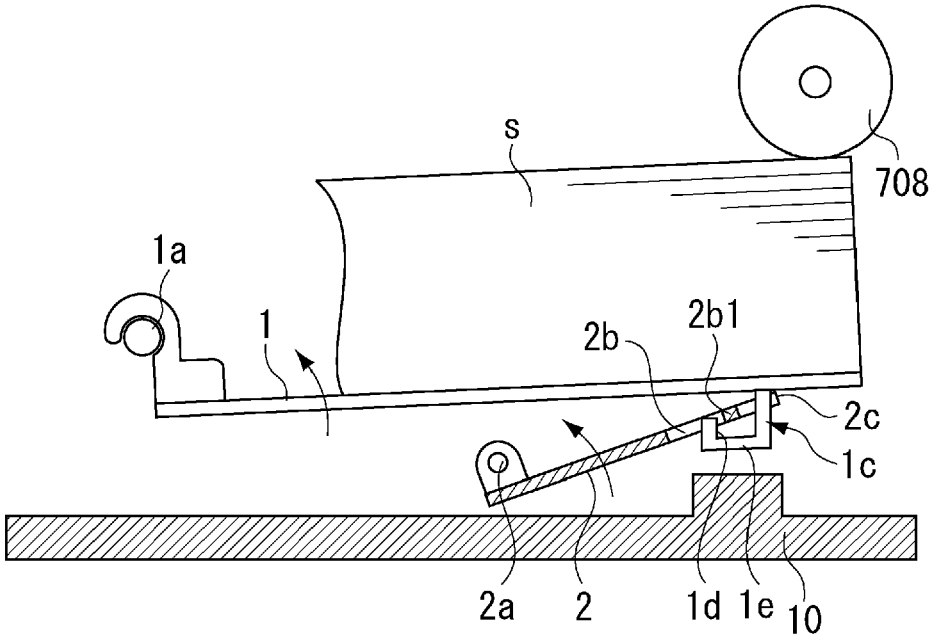
FIGS. 4A and 4B are sectional views each illustrating an operation of the lifting plate of the sheet feeding cassette illustrated in FIGS. 1A and 1B during image formation.
Figure 4B:
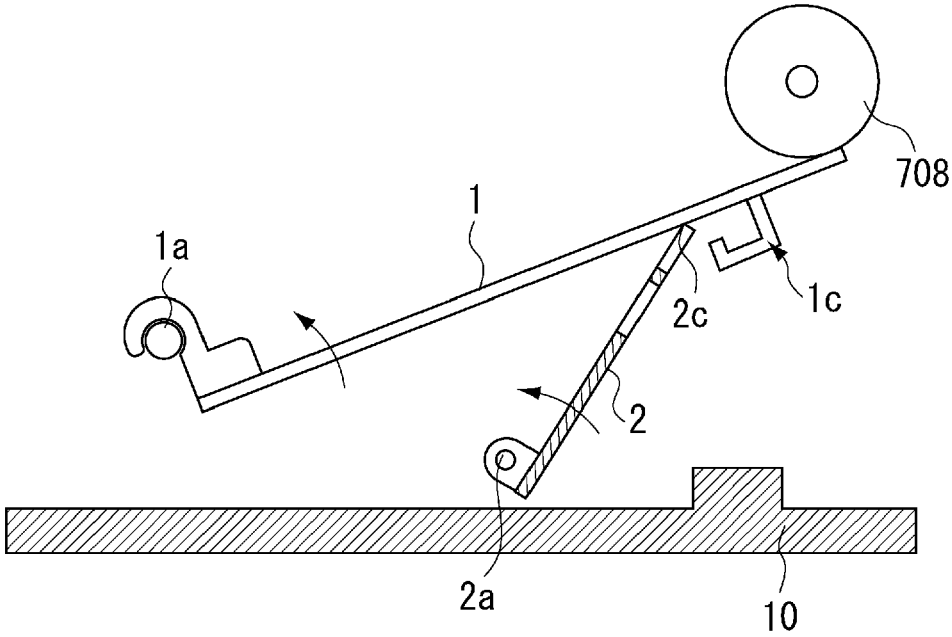

Hereinafter, an operation of the lifting plate 1 in ordinary sheet feeding will be described with reference to FIGS. 3A to 4B. FIG. 3A is a sectional view illustrating a sheet feeding standby state of the lifting plate 1, and FIG. 3B is a sectional view illustrating a state in which the pressing on the lifting plate 1 is started. FIG. 4A is a sectional view illustrating a state in which sheets placed on the lifting plate 1 are pressed by the sheet feeding roller 708, and FIG. 4B is a sectional view illustrating a state in which the lifting plate 1 is pressed against the sheet feeding roller 708 after the sheets on the lifting plate 1 are fed.

An engagement claw 1*c* in the form of a hook serving as an engaging member is projected from a lower surface of the lifting plate 1. The engagement claw 1*c* is kept in a state where a horizontal part 1*e* is placed on a projected part of the cassette case 10 in the standby state where the lifting plate 1 is not lifted up. The lifting plate pressing member 2 provided below the lifting plate 1 is being placed on an upper surface of the horizontal part 1*e* of the engagement claw 1*c*. One end 2*c* of the lifting plate pressing member 2 does not contact the lower surface of the lifting plate 1, so that a biasing force of the lifting plate biasing spring 4 is not transmitted to the lifting plate 1. An opening 2*b* to which a part of the engagement claw 1*c* can be inserted is formed on the lifting plate pressing member 2 at a position opposed to the engagement claw 1*c* of the lifting plate 1. The opening 2*b* is not limited to a hole. The opening 2*b* only needs to have a configuration that an edge 2*b*1 is formed to be engaged with a vertical surface 1*d* of the engagement claw 1*c* as described below. For example, a notch may be formed as the opening 2*b*. The edge 2*b*1 constitutes a member to be engaged in the present invention.

The lifting plate pressing member 2 rotates anticlockwise about the rotation center 2*a* as illustrated in FIG. 3B when the motor and the driving gear (not illustrated) of the pressing mechanism rotate, so that the one end 2*c* of the lifting plate pressing member 2 contacts the lower surface of the lifting plate 1 to start lifting up the lifting plate 1. The sheets S placed on the lifting plate 1 are pressed by the sheet feeding roller 708 as illustrated in FIG. 4A by further rotation of the lifting plate pressing member 2. Also, the sheets S placed on the lifting plate 1 are fed by the sheet feeding roller 708 to be gradually reduced in number, and each of the lifting plate pressing member 2 and the lifting plate 1 rotates about the rotation center following the reduction of sheets S. Ultimately, all of the sheets S placed on the lifting plate 1 are fed as illustrated to FIG. 4B, so that the lifting plate 1 is pressed against the sheet feeding roller 708. In this state, a sheet presence/absence detection unit (not illustrated) detects the absence of sheet, and the lifting plate 1 is lowered by inversed rotation of the motor and the driving gear (not illustrated) which brings the lifting plate pressing member 2 into the state illustrated in FIG. 3A. In this state, a user can pull out the sheet feeding cassette 50 to supply sheets.

Figure 1A:
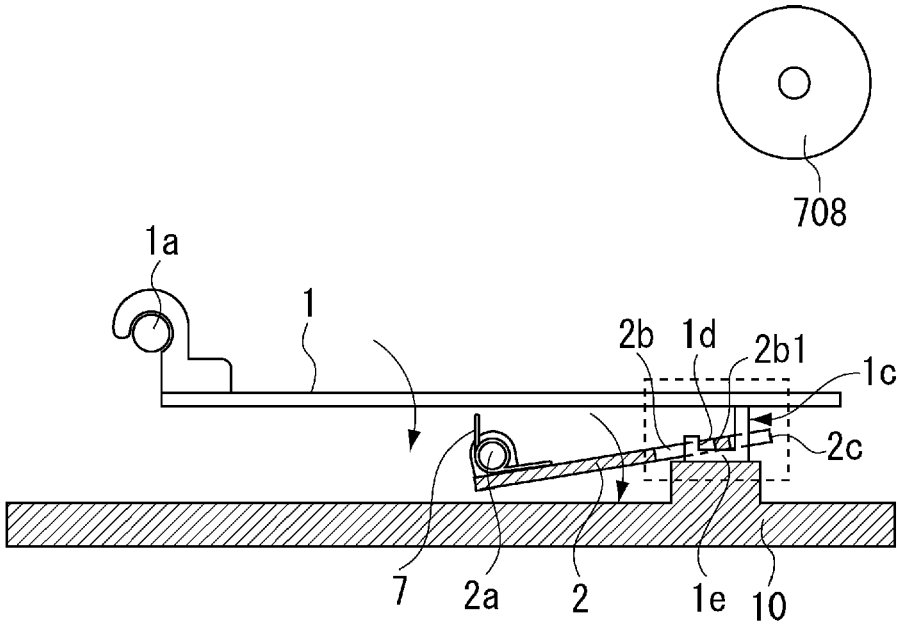
FIGS. 1A and 1B are sectional views each illustrating a fixing configuration of a lifting plate during transport in a sheet feeding cassette provided in a sheet feeding device according to a first exemplary embodiment.
Figure 1B:
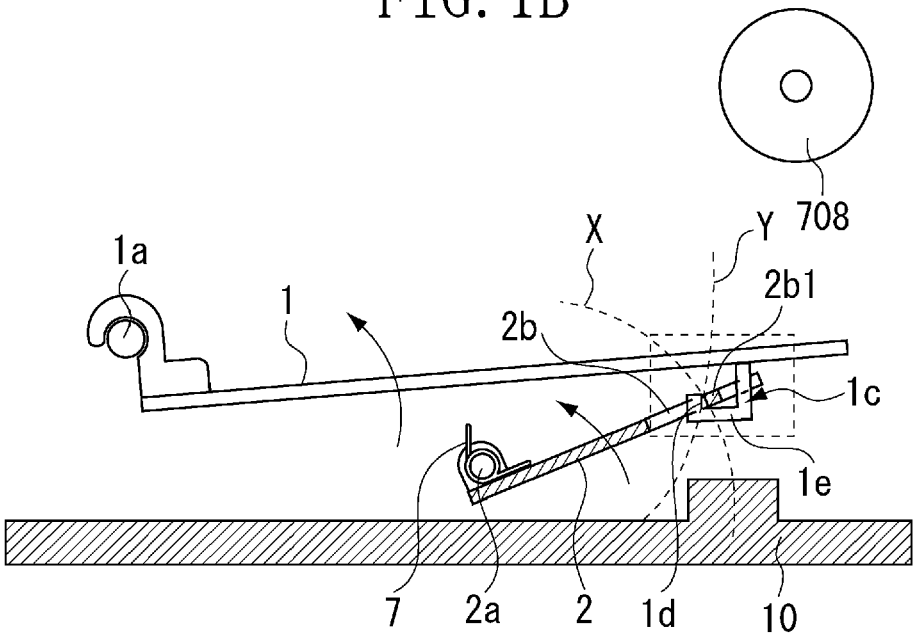
Figure 2:
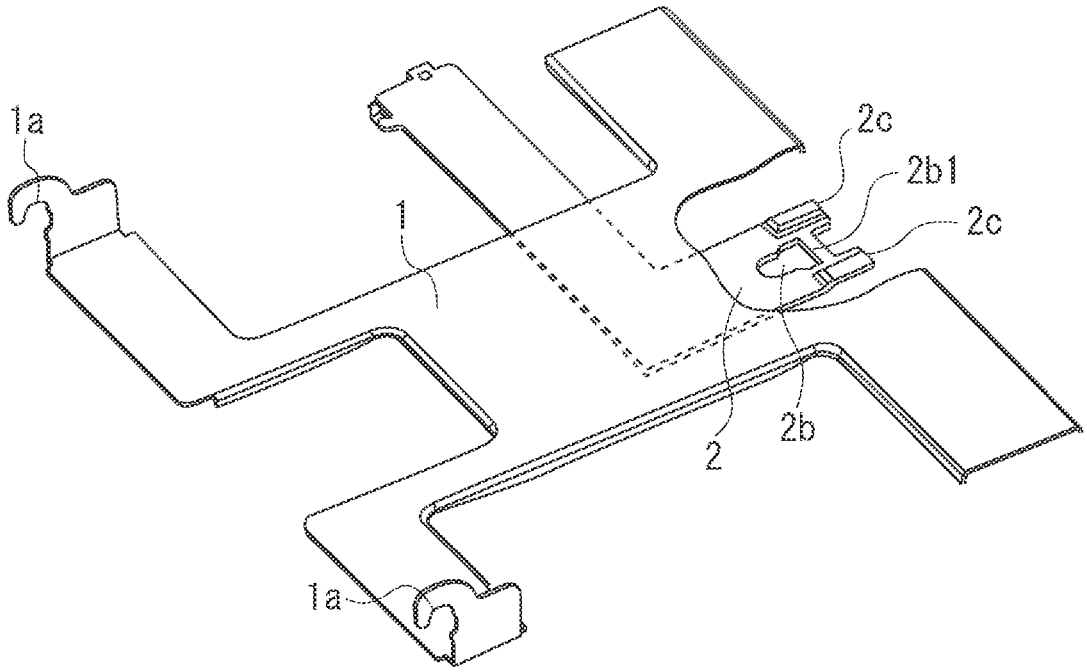
FIG. 2 is a perspective view illustrating a lifting plate pressing member of the sheet feeding cassette illustrated in FIGS. 1A and 1B.

Hereinafter, a method of fixing the lifting plate 1 during transport of the printer 100 or the sheet feeding cassette 50 will be described with reference to FIGS. 1A to 2. FIG. 1A is a sectional view illustrating a state in which the lifting plate 1 is moving downward due to an impact, vibration, or the like during transport, and FIG. 1B is a sectional view illustrating a state in which the lifting plate 1 is moving upward due to an impact, vibration, or the like during transport. FIG. 2 is a perspective view illustrating the lifting plate 1 and the lifting plate pressing member 2.

Referring to FIG. 1A, when the lifting plate 1 is moving downward due to an impact or vibration, the horizontal part 1*e* of the hook-like engagement claw 1*c* contacts the cassette case 10, so that the position of the lifting plate 1 is maintained. In this state, the lifting plate pressing member 2 contacts the horizontal part 1*e* of the engagement claw 1*c* of the lifting plate 1, so that the position of the lifting plate pressing member 2 is maintained.

When the lifting plate 1 is moving upward due to an impact or vibration as illustrated in FIG. 1B, the lifting plate pressing member 2 that contacts the horizontal part 1*e* of the hook-like engagement claw 1*c* is lifted up to be moved upward. When a posture of the lifting plate 1 is inclined by a predetermined degree (about five degrees in the present exemplary embodiment) from a horizontal posture, the edge 2*b*1 of the opening 2*b* of the lifting plate pressing member 2 is engaged with the vertical surface 1*d* of the hook-like engagement claw 1*c*. When the lifting plate 1 is rotating upward, movements of the lifting plate 1 and the lifting plate pressing member 2 are restricted due to different rotation tracks of the vertical surface 1*d* of the hook-like engagement claw 1*c* serving as the engaging member and the edge 2*b*1 of the opening 2*b* of the lifting plate pressing member 2 serving as the engaged member since the rotation center 1*a* of the lifting plate 1 and the rotation center 2*a* of the lifting plate pressing member 2 are different from each other. More specifically, referring to FIG. 1B, an arc X is the rotation track of the edge 2*b*1 of the opening 2*b* of the lifting plate pressing member 2, and an arc Y is the rotation track of the vertical surface 1*d* of the engagement claw 1*c*. The rotation tracks, which are the arc X and the arc Y, intersect with each other. The edge 2*b*1 and the vertical surface 1*d* are engaged with each other in a horizontal direction at a position where the arc X and the arc Y interest with each other, so that the edge 2*b*1 prevent the lifting plate 1 from moving upward from the position illustrated in FIG. 1B. Thus, when the lifting plate 1 is rotating upward, the edge 2*b*1 of the opening 2*b* of the lifting plate pressing member 2 is hooked by the vertical surface 1*d* of the hook-like engaging claw 1*c*, so that the lifting plate 1 is prevented from further upward movement. Accordingly, the lifting plate 1 is prevented from moving upward by a degree that is larger than the predetermined degree, thereby making it possible to restrict the lifting plate 1 to the movement within the small angle. The lower the position of the intersection between the arc X which is the rotation track of the vertical surface 1 of the engagement claw 1*c* and the arc Y which is the rotation track of the edge 2*b*1 of the opening 2*b* of the lifting plate pressing member 2 (closer the intersection position to a bottom surface of the cassette case 10), the smaller the angle (about five degrees in the present exemplary embodiment) to which a movement range of the lifting plate 1 is restricted.

Also, an inverse rotation prevention spring 7 which is a screw coil spring may be provided on the rotation center 2*a* of the lifting plate pressing member 2 as illustrated in FIG. 1A. The lifting plate pressing member 2 is biased in a direction (downward) opposite to the lifting direction of the lifting plate by providing the inverse rotation prevention spring 7, so that the lifting plate pressing member 2 is prevented from moving upward before the lifting plate 1 moves upward. Therefore, the upward movement of the lifting plate 1 is reliably restricted.

According to the above-described configuration, since it is possible to limit the movement range of the lifting plate 1 by the lifting plate pressing member 2 and the lifting plate 1, the dedicated packaging material that has been required in the conventional technology is no longer necessary, which eliminates the cost increase. Further, since it is unnecessary to cause the user to remove or move the packaging material when unpacking the apparatus, it is possible to reduce the labor of the user, thereby improving usability.

Hereinafter, a second exemplary embodiment of a sheet storing device and an image forming apparatus according to the present invention will be described with reference to FIGS. 8A and 8B. A configuration different from that of the first exemplary embodiment will be described in detail, and description of the same configuration will not be repeated.

Figure 8A:
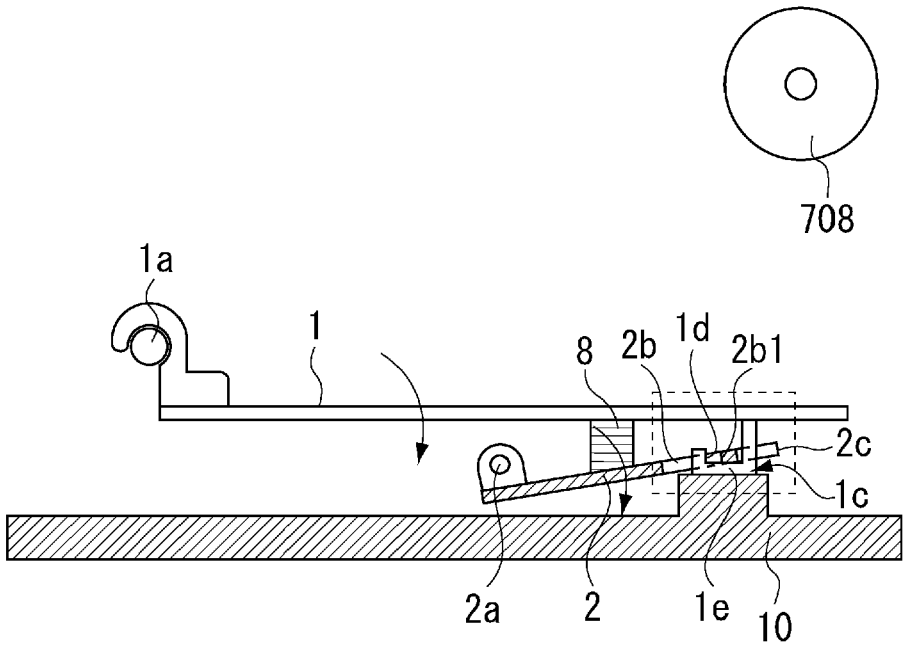
FIGS. 8A and 8B are sectional views each illustrating a fixing configuration of a lifting plate during transport in a sheet feeding cassette provided in a sheet feeding device according to a second exemplary embodiment.

As illustrated in FIG. 8A, an inverse rotation prevention spring 8 which is a compression spring is disposed between the lower surface of the lifting plate 1 and the upper surface of the lifting plate pressing member 2, this configuration is different from that of the first exemplary embodiment. The lifting plate pressing member 2 is biased in a direction (downward) opposite to the direction of lifting up the lifting plate by the provision of the inverse rotation prevention spring 8, so that the lifting plate pressing member 2 is prevented from moving upward before the lifting plate 1 moves upward.

Figure 8B:
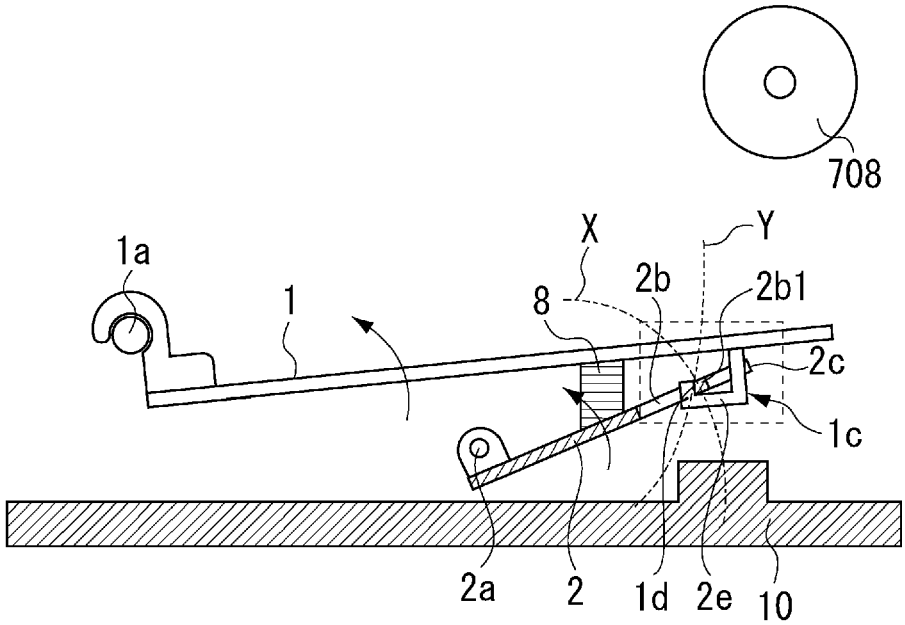

When the lifting plate 1 is moving upward due to an impact or vibration as illustrated in FIG. 8B, the lifting plate pressing member 2 that contacts the horizontal part 1*e* of the hook-like engagement claw 1*c* is lifted up to move upward. When a posture of the lifting plate 1 is inclined by a predetermined degree from a horizontal posture, the edge 2*b*1 of the opening 2*b* of the lifting plate pressing member 2 is engaged with the vertical surface 1*d* of the hook-like engagement claw 1*c*. When the lifting plate is rotating upward, movements of the lifting plate 1 and the lifting plate pressing member 2 are restricted due to different rotation tracks of the vertical surface 1*d* of the hook-like engagement claw 1*c* and the edge 2*b*1 of the opening 2*b* of the lifting plate pressing member 2 since the rotation center 1*a* of the lifting plate 1 and the rotation center 2*a* of the lifting plate pressing member 2 are different from each other. Description of the restriction operation will not be repeated since the restriction operation is the same as that of the first exemplary embodiment.

As described above, since the lifting plate 1 is prevented from moving upward by a degree that is larger than the predetermined degree, it is possible to restrict the lifting plate 1 to the movement within the small angle in the same manner as in the first exemplary embodiment. Thus, an effect same as that of the first exemplary embodiment is attained.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-285755 filed Dec. 16, 2009, which is hereby incorporated by reference herein in its entirety.

What is claimed is:

1. A sheet feeding device comprising a sheet feeding cassette that stores sheets, a sheet feeding unit feeds the sheets from the sheet feeding cassette, the sheet feeding cassette including:

a cassette case;

a lifting plate that is rotatably supported about a rotation center in the cassette case, on which the sheets are placed; and a pressing member that is rotatably supported about a rotation center below the lifting plate and rotates upward the lifting plate about the rotation center of the lifting plate while the pressing member rotates from a standby position to press the sheet to the sheet feeding unit;

an engaging member provided on the lifting plate;

an engaged member provided on the pressing member engaged with the engaging member, wherein positions of rotation centers of the lifting plate and the pressing member are varied from each other and are arranged in the same side for a press position that the pressing member presses the lifting plate in such a manner that a rotation track of the engaging member and a rotation track of the engaged member intersect with each other, the engaged member restricts the engaging member at an intersection position of the rotation tracks to restrict rotation of the lifting plate when the lifting plate is rotated upward in the state that the pressing member is positioned in the standby position.

2. The sheet feeding device according to claim 1, further comprising a biasing unit that biases the pressing member in a direction opposite to a lifting direction of the lifting plate.

3. The sheet feeding device according to claim 1, wherein the engaging member is a hook-like engagement claw projected from a lower surface of the lifting plate and the engagement claw has an engaging portion, wherein the engaged member is formed on the lifting plate and is an edge which is an opening or a notch to which the engagement claw can be inserted, and wherein when the lifting plate is rotated upward, the edge is intersected with the engaging portion to restrict rotation of the lifting plate.

4. An image forming apparatus comprising a sheet feeding device that feeds sheets by a sheet feeding unit from a sheet feeding cassette storing the sheets and an image forming unit that forms an image on the sheets fed by the sheet feeding device, wherein the sheet feeding cassette includes:

a cassette case;

a lifting plate that is rotatably supported about a rotation center by the cassette case on which the sheets are placed; and a pressing member that is rotatably supported about a rotation center below the lifting plate and rotates upward the lifting plate about the rotation center of the lifting plate while the pressing member rotates from a standby position to press the sheet to the sheet feeding unit;

an engaging member provided on the lifting plate;

an engaged member provided on the pressing member engaged with the engaging member, wherein positions of rotation centers of the lifting plate and the pressing member are varied from each other and are arranged in the same side for a press position that the pressing member presses the lifting plate in such a manner that a rotation track of the engaging member and a rotation track of the engaged member intersect with each other, the engaged member restricts the engaging member at an intersection position of the rotation tracks to restrict rotation of the lifting plate when the lifting plate is rotated upward in the state that the pressing member is positioned in the standby position.

5. The image forming apparatus according to claim 4, further comprising a biasing unit that biases the pressing member in a direction opposite to a lifting direction of the lifting plate.

6. The image forming apparatus according to claim 4, wherein the engaging member is a hook-like engagement claw projected from a lower surface of the lifting plate and the engagement claw has an engaging portion, wherein the engaged member is formed on the lifting plate and is an edge which is an opening or a notch to which the engagement claw can be inserted, and wherein when the lifting plate is rotated upward, the edge is intersected with the engaging portion to restrict rotation of the lifting plate.

* * * * *